United States Patent [19]

Cote

[11] 4,227,708

[45] Oct. 14, 1980

[54] SKI BRAKE

[76] Inventor: Bernard Cote, 12,270 rue St-Evariste, Montreal, Quebec, Canada, H4J 2B7

[21] Appl. No.: 964,808

[22] Filed: Nov. 29, 1978

Related U.S. Application Data

[63] Continuation-in-part of Ser. No. 823,332, Aug. 10, 1977, abandoned.

[51] Int. Cl.[3] ..... A63C 7/00

[52] U.S. Cl. ..... 280/809; 280/604

[58] Field of Search ..... 280/604, 11.37 G, 11.37 E, 280/11.37 R, 601, 609, 11.37 N, 11.37 L, 11.37 B, 11.37 P, 11.37 Z, 605, 606

[56] References Cited

U.S. PATENT DOCUMENTS

| | | | |
|---|---|---|---|
| 3,567,239 | 3/1971 | Kitterman | 280/11.37 G |

FOREIGN PATENT DOCUMENTS

| | | | |
|---|---|---|---|
| 816949 | 8/1937 | France | 280/11.37 G |
| 426891 | 11/1947 | Italy | 280/11.37 E |
| 70525 | 6/1946 | Norway | 280/604 |
| 98415 | 3/1940 | Sweden | 280/604 |
| 185699 | 12/1936 | Switzerland | 280/11.37 G |
| 221621 | 6/1942 | Switzerland | 280/606 |

*Primary Examiner*—David M. Mitchell

[57] ABSTRACT

A ski brake, more specifically for use in association with cross-country skis and including a plate fixed to, and extending outwardly from each ski near the conventional harness. The plate includes an attachment portion and a ski pole catching portion, the latter having a rearwardly directed notch to receive the ski pole with the basket of the pole against the bottom of the ski. The notch is oriented relative to the ski to form in the ski pole catching portion a hooking portion which projects transversely inward toward the ski and restrain the ski pole in the notch. In one embodiment, each plate includes an upwardly directed flange at its outer edge provided with a notch to receive the rim of the ski pole basket and thus providing for downhill braking. The ski pole may have a flexible joint to enable convenient positioning of the ski pole handles relative to the skier. In a preferred embodiment, the ski pole is provided with an annular spacer of predetermined thickness and outside diameter to hold the basket flat against the bottom of the ski and to hold the ski pole against unintentional disengagement with the ski pole hooking portion.

9 Claims, 11 Drawing Figures

SKI BRAKE

This is a continuation-in-part of my co-pending patent application Ser. No. 823,332, filed Aug. 10, 1977, and now abandoned.

This invention relates to skis, specifically cross-country skis, and is particularly concerned with a ski brake assembly of the type permitting a skier to walk uphill while maintaining the skis substantially parallel.

The present invention introduces a novel ski brake extremely simple to apply and effective in reducing or stopping rearward motion on an uphill slope and functional regardless of the type of snow encountered.

Accordingly, it is an object of the present invention to provide a ski brake easily applied and maintained with a minimum of muscular effort even on hard snow.

It is another object of the present invention to provide a ski brake assembly which uses the ski poles to produce a braking drag and wherein the ski poles are positively retained against unintentional disengagement from the braking position.

It is a further object of the present invention to provide a ski brake which can be used while keeping the skis in parallel walking or sliding position.

It is a still further object of the present invention to provide a ski brake wherewith it is possible to apply the brake while maintaining a smooth uninterrupted reduced motion in the normal walking and sliding position.

It is another object of the present invention to provide a ski brake incorporating braking means effective when sliding downhill.

The above and other objects and advantages of the present invention will be better understood with reference to the following detailed description of preferred embodiments thereof which are illustrated, by way of examples, in the accompanying drawings, in which.

Like numerals indicate like elements.

Figure 1:
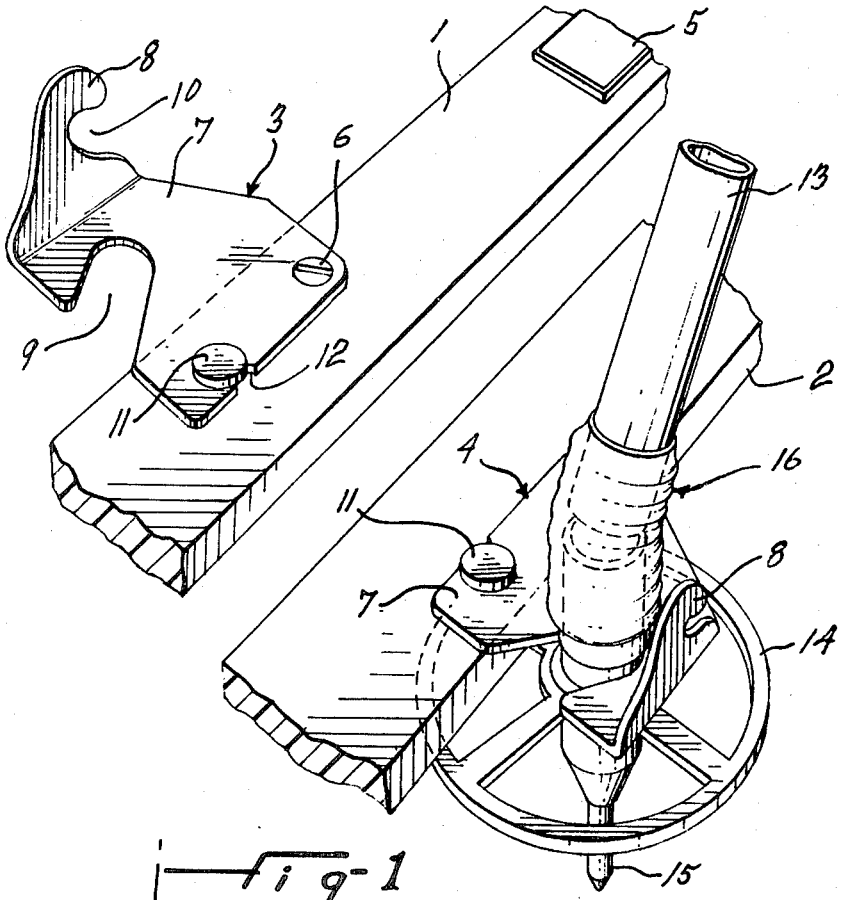
FIG. 1 is a perspective view of a pair of skis with their ends broken away and each provided with a ski brake assembly installed thereon according to a first embodiment of the present invention.

Left ski 1 and right ski 2 are provided with a left plate 2 and a right plate 4 respectively fastened to the top of each ski behind and adjacent the harness 5. The plates 3 and 4 are pivotally fastened to the skis by screws 6 shown in FIG. 1 and FIG. 3. The plates 3 and 4 are mirror images of each other such that plate 3 fits only on the left ski and plate 4 on the right ski. Both brake plates 3 and 4 consist of a horizontal and generally square flat plate 7 including a ski pole catching portion, an attachment portion, and a vertical flange 8 generally triangular and projecting vertically upward from the outside edge of the flat plate 7. A finger-like notch 9 cuts into the back edge of the ski pole catching portion of the flat plate 7 and is oriented frontwardly away from the ski at an angle of approximately 30°. Another hook notch 10 cuts upwardly into the leading front edge of the vertical flange 8. The notch 9 is shaped to form a ski pole hooking portion 20 which transversely projects inward toward the ski and rearward of the inner end of the notch.

Figure 3:
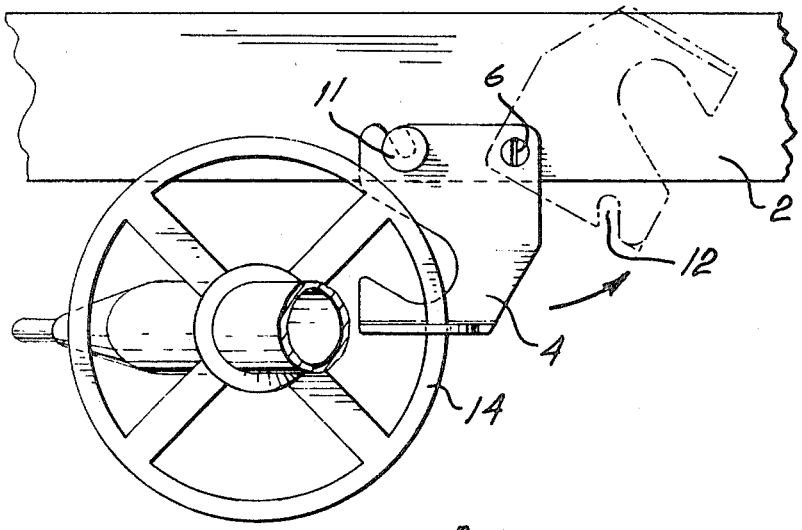
FIG. 3 is a top view of the ski brake assembly of FIG. 2 in association with the central portion of the ski.

The plates 3 and 4 may occupy a use and a non-use position as indicated in FIG. 3. When a plate is to be used it projects laterally outward from the ski as in FIGS. 1 and 3 and is held securely in place in the plane of the top surface of the ski by screw 6 and a retaining stud 11 fixed to the ski and engaging a small notch 12 cutting rearwardly into the inside edge of the flat plate 7. The attachment portion of the flat plate 7 is secured onto the ski while the ski pole catching portion projects laterally outward from the ski. The plates 3 and 4 may be pivotally rotated about the screws 6, as indicated by the arrow in FIG. 3, to an out-of-the-way non-use position on top of, and flush with, the top surface of the ski, as shown by the dashed outline in FIG. 3.

A special pole 13 includes a ski pole basket 14, an elongated spike 15 tapered to a point, and a flexible joint 16. The flexible joint 16 comprises an upper segment 13′ of the special pole 13 interfacing with a lower segment 13″ of the special pole 13. The upper and lower segments 13′ and 13″ are separate from each other and are held flexibly together by a tightly fitting coil spring 17 wrapped equally around upper segment 13′ and lower segment 13″ and secured in place to the pole by the spring 19. Flexible joint 16 also includes a protective tightly fitting sleeve 18, of rubber or other suitable material with elastic properties. Flexible joint 16 is located slightly above basket 14.

Figure 7:
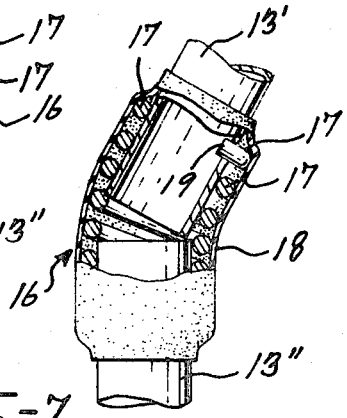
FIG. 7 is another elevation view of the same flexible joint shown in bent position and with part broken away.
Figure 8:
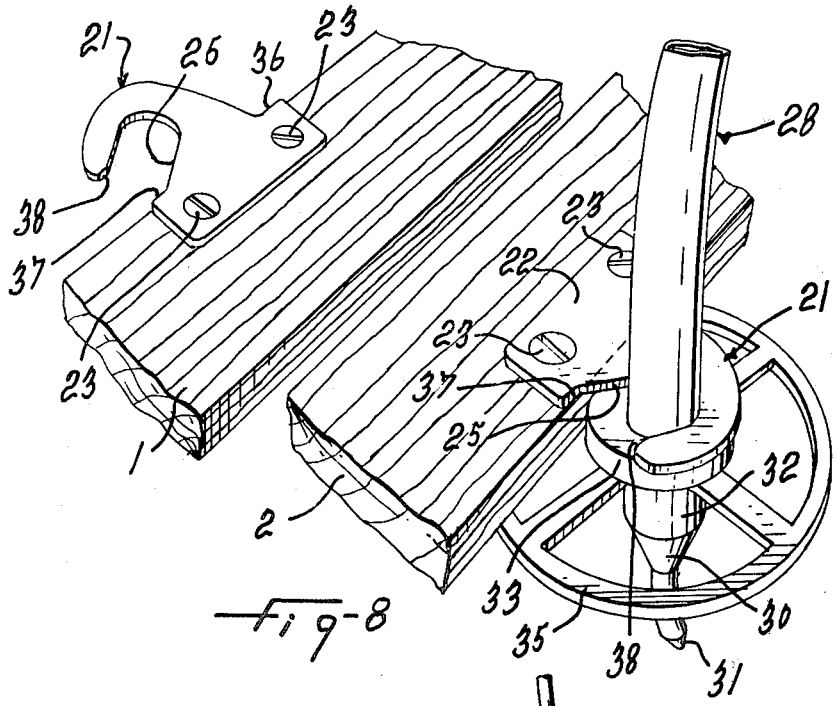
FIG. 8 is a perspective view as in FIG. 1 but with a ski brake assembly according to another embodiment of the present invention.
Figure 9:
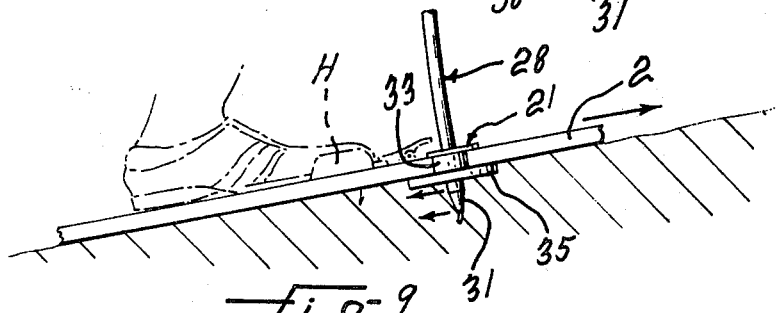
FIG. 9 is a side elevation view of a right-hand ski with the ski brake assembly of FIG. 8 secured thereto to brake against backward sliding while walking uphill.
Figure 10:
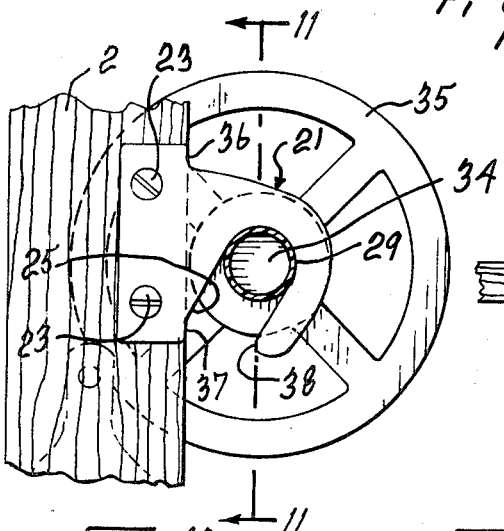
FIG. 10 is a top view of the ski brake assembly of FIGS. 8 and 9.
Figure 11:
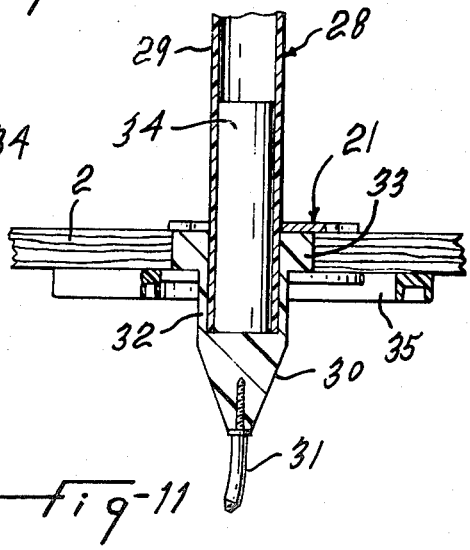
FIG. 11 is a sectional view through a ski pole with the latter operatively associated to the ski.

Clearly, flexible joint 16 permits special pole 13 to be bent like an elbow in any direction desired. As shown in FIG. 7, when the upper segment of the pole is bent in a particular direction relative to the lower segment of the pole, the resultant interfacing point of contact 18 between the circumferential edges of the upper and lower segments acts as a fulcrum. As the direction of the bending is changed, the point of contact 18 correspondingly shifts on the circumferential interfacing.

When the special pole 13 is not required for braking, the spring 17 and, to a lesser extent, the elastic sleeve 18 acts as a stiff biasing force to keep the special pole 13 straight.

Figure 4:
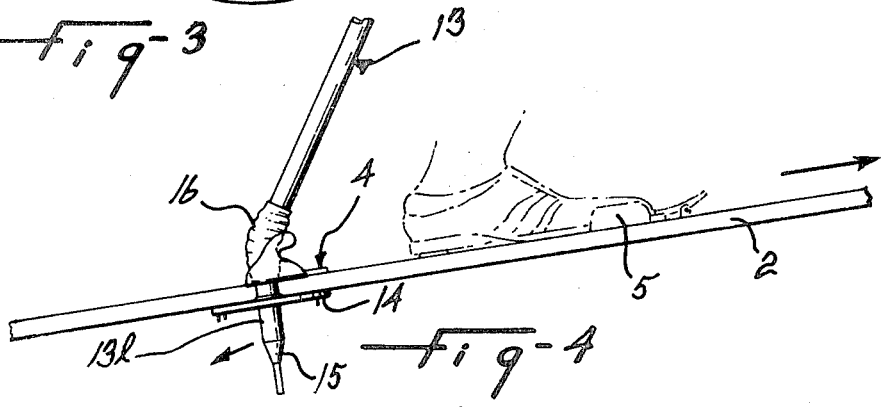
FIG. 4 is a view corresponding to the view of FIG. 2 but with the ski shown going uphill rather than downhill.
Figure 5:
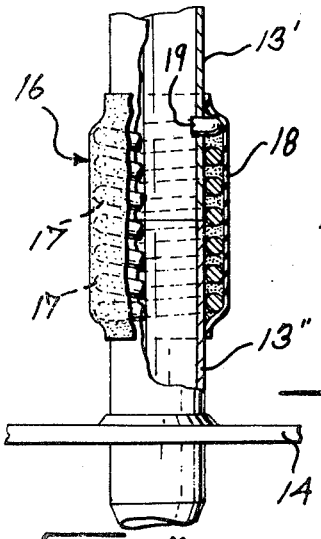
FIG. 5 is an elevation view of a flexible joint in the ski shown in unbent position and with part broken away.
Figure 6:
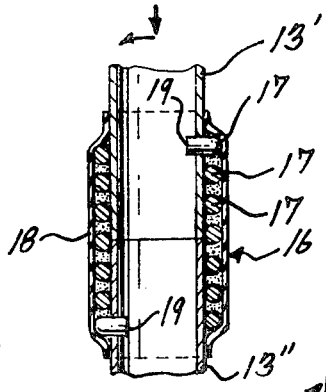
FIG. 6 is a longitudinal section through the flexible joint.

When the skier is on a slope facing uphill and wishes to use the aforedescribed ski brake to prevent rearward motion down the slope he proceeds as follows: lifting up the back of a ski, for example right ski 2 whereon plate 4 is secured, he engages special pole 13 in notch 9 of plate 4 such that flexible joint 16 is immediately above flat plate 7 of plate 4 and a portion of the inwardly facing arc of basket 14 slips underneath and is flush with the bottom surface of ski 2, as shown in FIG. 1 and FIG. 4. Then, by letting the back of ski 2 down again on the snow surface of the slope, elongated spike 15 digs downward into the snow with basket 14 flat on the snow surface and having part of its inwardly facing arc sandwiched between the snow surface under ski 2 and the bottom surface of ski 2, as in FIGS. 1 and 4. At the same time, by holding on the handle not shown of special pole 13, the skier causes flexible joint 16 to bend at an angle such that the handle remains comfortably in front of him and to his side, and lower segment 13'' of special pole 13 remains perpendicular to ski 2, as in FIG. 4. The entire manoeuver is repeated for the left ski with another special pole 13.

With special pole 13 thus in braking position, elongated spike 15 is buried in the snow creating an effective drag against downhill, rearward slipping. In addition, a second much more effective drag is created by basket 14: firstly, basket 14 is flat on the surface of the snow; secondly, that part of the inwardly facing arc of basket 14 sandwiched under the ski effectively interrupts the low-friction sliding surface of the ski itself; furthermore, the entire weight of the skier rests on the sandwiched portion of basket 14 since it is under the ski. These two combined drags act as an effective brake on each ski, preventing rearward, downhill slipping motion. It is to be noted that no muscular strength at all is required from the skier to maintain the braking force as his weight alone on the ski and on basket 14 performs the work.

Alternatively, if the skier does not wish to stop on the slope but wishes to proceed uphill, by keeping the poles in braking position he may effectively brake the ski which is not moving while the other ski is lifted off the snow and moved forward uphill. During this forward movement the associated pole remains in position in notch 9 while being pulled upwardly by the skier's hand. It is essential that means positively maintain plate 7 in the plane of the top surface of the ski, otherwise the basket 14 being either flexible or pivotally attached to the ski pole would become dislodged from its braking position under the ski bottom surface during forward movement of the ski and pole. It is to be noted that the angular position of notch 9 on plates 3 and 4 and the hooking portion 20 prevent special pole 13 from dislocating out of the notch while the ski is moving.

Figure 2:
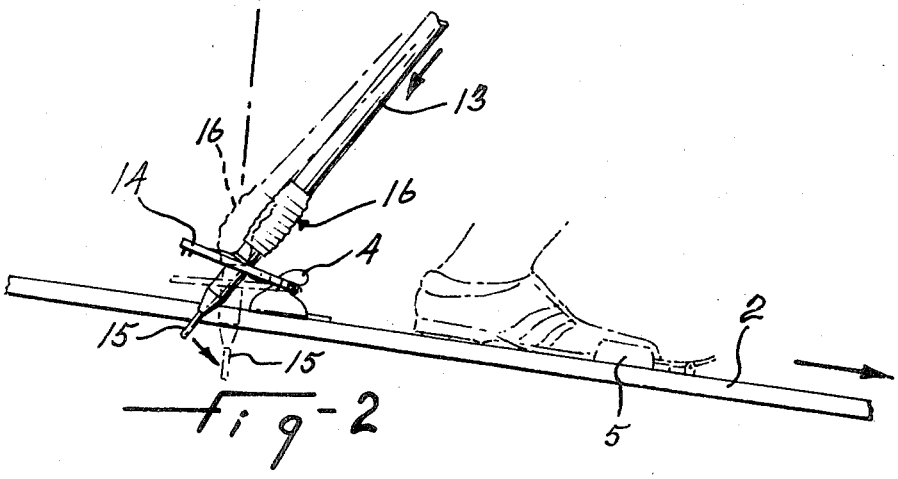
FIG. 2 is a side elevation of a right-hand ski provided with a ski brake assembly as in FIG. 1.

The aforedescribed ski brake is equally useful as a brake to refrain or prevent downhill forward motion when the skier is facing downhill. In this case the skier proceeds as follows: the annular rim of basket 14 is firstly engaged in hook notch 10 of plate 4 as shown in FIG. 2. Then, the skier pushes down on special pole 13 as indicated by the arrow in FIG. 2. This action exerts a leverage force on flexible joint 16, causing it to bend, thus biasing elongated spike 15 forwardly and downwardly into the snow, perpendicular to ski 2, as shown by the dashed outline of FIG. 2. Elongated spike 15 creates an effective drag against forward downhill motion indicated by the arrow in FIG. 2. It is to be noted here that little strength is needed to bend special pole 13 in this manner as the leverage action is obtained upon pivoting of the rim of basket about notch 10. The braking action is adjusted by pushing down on the handle of the pole 13 to angle spike 15 to the desired degree.

The procedure is repeated for the left ski.

When forward downhill motion is prevented in the conventional method of pushing ordinary poles against downhill motion, instability is inevitable because the braking force is exerted above the skier's center of gravity, in his arms. Whereas, according to the present invention, it is the skis themselves which are braked, below the skier's center of gravity. Thus, not only is effort greatly reduced but no extra effort is required, as in a snowplow position, to keep the skis as well as the body motionless.

Evidently, the effective power of the ski brake according to the present invention will tend to vary somewhat depending on snow conditions as well as the steepness of the slope on which the skier finds himself. For example, it is clear that effective braking power would be greater on dense or icy snow as such snow naturally offers more resistance, and less in loose, granular, or powdery new snow. Also, on a very steep downhill slope, a complete downhill facing stop may not be possible, in which case the skier need only turn partially sideways to the hill and employ the present invention in that position.

Alternatively, the aforedescribed ski-brake permits a skier to ski downhill at a reduced, sure speed, by keeping special poles 13 in the hook notches 10, should the slope be quite steep.

Special poles 13 can easily be adapted from a regular ski pole by simply cutting it in a suitable position above the basket and providing a coil spring and sleeve described hereabove; the special poles and plates are inexpensive and easy to install, the special poles do not exclude the possibility of using them in any conventional manner, even conventional braking, and the plates are lightweight and do not hinder any ski manoeuver.

The ski brake assembly according to the second embodiment of the present invention, and as illustrated in FIGS. 8 to 11 inclusive comprises a plate 21 which is fixed either to the left ski 1 or the right ski 2; it has only to be flipped over such that the top on one side becomes the bottom on the other side.

The plate 21 includes an attachment portion 22 which overlies the corresponding ski and is secured to it by a pair of screws 23. The plate 21 also includes a ski pole catching portion 24 which projects laterally outward of the corresponding attachment portion 22 and ski 1 or 2. A ski pole hooking notch 25 opens at the rear edge 26 of the ski pole catching portion 24 and extends in the latter angularly away from the ski. The notch 25 thus forms in the ski pole catching portion 24 a ski pole hooking portion 27 projecting transversely inward toward the corresponding ski 1 or 2 and rearward of an inner portion of the notch 25. Thus, the ski pole 28 laterally engaging in the notch 25 is operatively restrained against unintentional rearward disengagement when the ski is lifted up to walk one step forward with it.

The ski pole 28 includes a tubular main body 29 capped at the lower end by a pointed body 30 having a spike 31 projecting from the pointed end thereof and a tubular portion 32 at the opposite end fitting over and secured to the lower end of the main tubular body 29. The tubular portion 32 is formed with an annular outer portion 33 at the upper end thereof. A rod 34 is fixed inside the lower end of the tubular main body 29 in registry with the capping member 30 to strengthen the ski pole against collapse under the action of the plate 21 against it upon braking. The ski pole 28 also includes a basket 35 abutting axially against the lower annular face of the annular portion 33.

The latter is of predetermined thickness and outside radius. More specifically, the annular portion 33 forms an annular spacer whose thickness is substantially equal to the thickness of the ski, whereby when the annular spacer 33 abuts against the bottom of the corresponding plate 21, the basket 35 rests flat against the bottom of the corresponding ski 1 or 2. Thus, when the load is applied on the ski, the basket 35 abuts flat against the bottom of the ski and provides drag by itself in addition to forcing the spike 31 directly into the snow to also obtain drag by it.

The annular spacer 33 has an outside radius such that the sum thereof with the radius of the main tubular body 29 exceeds the clearance spacing between the ski pole hooking portion 27 and the corresponding ski 1 or 2, thus, the ski pole is retained against direct rearward displacement longitudinally of the ski to disengage the notch 25. Thus, when the skier walks uphill, he only has to pull slightly upward on the ski poles to keep the baskets in contact with the bottom of the skis when he moves his foot upward to move one step forward. The ski pole can intentionally be disengaged by lifting the foot up to be able to push down on the ski pole to relatively lower the spacer 33 below the ski; this then allows to laterally displace the ski pole out of the notch 25 whose width is intentionally only slightly larger than the diameter of the ski pole. It results that even if the skier neglects to upwardly bias the ski pole basket against the bottom of the ski when he walks forward, the angle of the notch and its width are such that the ski pole is not likely to disengage from the notch. It results that very little skill is required to positively progress uphill with this ski brake.

The tubular main body 29 is made of resilient and somewhat flexible material having uniform flexibility throughout its length so that, when engaged in notch 25, it can bend along its length so that the ski pole handle (not shown) can be held by the skier at the most convenient position, forwardly and laterally outward of the plate 21 while spike 31 remains perpendicular to the ski underface and basket 35 remains flat against said underface.

Plate 21 is fixed to the ski ahead of the conventional ski harness H and does not protrude from the side of the ski any more than the harness.

Plate 21 has a step 36 which, together with longitudinally aligned entry edge portion 37 of notch 25, forms a reference line for securing plate 21 in proper alignment with the ski 1 or 2 and with portion 37 flush with the side of the ski.

Also, entry edge portions 37 and 38 are substantially parallel to the ski side to facilitate entry of the ski pole into the main inclined portion of the notch 25. What I claim is:

1. A ski brake assembly comprising a plate operatively securable to a ski and including an attachment portion securable to the ski and a ski pole catching portion projecting from the attachment portion laterally from the ski on the outward side thereof and defining a rear edge with a hooking notch opening at said rear edge, extending in said ski pole catching portion, and forming in the latter a ski pole hooking portion projecting transversely inward toward the ski and rearward of an inner portion of the ski pole hooking notch whereby a ski pole laterally engaging in said notch is operatively restrained longitudinally of the ski by said ski pole hooking portion.

2. A ski brake assembly as defined in claim 1, further comprising the ski pole, the catching plate portion extending flat substantially co-planar with the top of the ski, and said ski pole having a basket and a spacer positioned over said basket and having a thickness substantially equal to the thickness of said ski whereby upon engagement of said ski pole laterally in said notch with said spacer against the bottom of said ski pole catching portion, said basket engages substantially flat against the bottom of the ski.

3. A ski brake assembly as defined in claim 2, wherein said spacer is annular and has a predetermined outside radius which, in addition to the radius of the ski pole, exceeds the clearance space operatively remaining between the ski pole hooking portion and the outward lateral side of the ski whereby the ski pole remains longitudinally caught in said notch unless said ski pole is relatively moved downward to lower the spacer below the ski.

4. A ski brake assembly as defined in claim 3, wherein said notch is elongated, defining opposite sides extending from said rear edge angularly outward relative to the ski and the spacing between said opposite sides slightly exceeds the diameter of the ski pole for lateral displacement of the latter longitudinally of said notch.

5. A ski brake assembly as defined in claim 4, wherein said ski pole includes a main tubular body, a cap member fitted over the lower end of said main tubular body and including a tubular portion having an enlarged rim portion forming said annular spacer around the lower end of said main tubular body, said basket axially abutting against the lower axial end of said annular spacer portion, and a strengthening rod member is fitted in the lower end of said main tubular body in registry with said annular spacer portion.

6. The combination as claimed in claim 5, wherein each plate further includes a flange projecting upwardly from the outside edge of said plate, said flange having a leading edge provided with a second notch to receive the rim of the basket of the ski pole, whereby the lower end of the ski pole can be forced to project downwardly into the snow below the ski to effect braking of frontward downhill motion of the ski.

7. The combination as claimed in claim 6, wherein said plate is pivotally secured to the top surface of the ski by means of a screw acting as a pivot about which said plate can rotate between an in-use position projecting outwardly from the outer side of said ski and a non-use position in which said plate is on top of said ski and within the confines of said ski, said plate, in its in-use position, being retained by a stud affixed to the top surface of said ski and removably engaging a third notch opening at the inside edge of said plate, said screw and stud constituting means to positively retain the plate in the plane of the ski top surface.

8. The combination as claimed in claim 7, wherein said second notch is generally hook-shaped and oriented rearwardly and upwardly in the said leading edge of said flange.

9. The combination as claimed in claim 1, wherein each plate further includes a flange projecting upwardly from the outside edge of said plate, said flange having a leading edge provided with a hook-shaped notch oriented rearwardly and upwardly to receive the rim of the basket of the ski pole, whereby the lower end of the ski pole can be forced to project downwardly into the snow below the ski to effect braking of frontward downhill motion of the ski.

* * * * *